US006273245B1

(12) United States Patent
Mickelson

(10) Patent No.: US 6,273,245 B1
(45) Date of Patent: Aug. 14, 2001

(54) ARTICLE HOLDING ASSEMBLY FOR A PURSE

(76) Inventor: Douglas Mickelson, 7009 Sunnyside St., Fargo, ND (US) 58104-5309

( * ) Notice: Subject to any disclaimer, the term of this patent is extended or adjusted under 35 U.S.C. 154(b) by 0 days.

(21) Appl. No.: 09/507,611

(22) Filed: Feb. 21, 2000

(51) Int. Cl.[7] ..... A45C 11/32; A45C 1/02

(52) U.S. Cl. ..... 206/37.1; 206/37.3; 150/113

(58) Field of Search ..... 206/37, 37.1, 37.3, 206/37.5; 150/106, 113; 224/269, 666

(56) References Cited

U.S. PATENT DOCUMENTS

| | | | | |
|---|---|---|---|---|
| 804,545 | * | 11/1905 | Paine | 206/37.1 |
| 1,414,798 | * | 5/1922 | Welcker | 206/37.1 |
| 1,579,017 | * | 3/1926 | Marymont | 206/38.1 |
| 1,618,573 | * | 2/1927 | Cole | 224/666 X |
| 1,849,080 | * | 3/1932 | Embree | 206/37.5 |
| 2,416,477 | * | 2/1947 | Gamache | 206/37.1 X |
| 2,455,968 | * | 12/1948 | Baker | 206/37.1 X |
| 2,850,152 | * | 9/1958 | Marrufo | 224/666 X |
| 3,326,258 | * | 6/1967 | Stucker | 150/106 X |
| 4,004,325 | * | 1/1977 | Hubachek | 206/27.1 X |
| 4,940,250 | * | 7/1990 | Corrado | 206/37.1 |
| 5,983,686 | * | 11/1999 | Lee | 224/269 X |
| 6,082,600 | * | 7/2000 | Angus et al. | 224/269 |

FOREIGN PATENT DOCUMENTS

| | | | | |
|---|---|---|---|---|
| 289 | * | 10/1888 | (GB) | 206/37.1 |

* cited by examiner

*Primary Examiner*—Sue A. Weaver
(74) *Attorney, Agent, or Firm*—Michael S. Neustel

(57) ABSTRACT

An article holding assembly for a purse for conveniently storing a plurality of keys within a purse or other bag with the keys positioned in an easily accessed area within the purse. The inventive device includes a support case having a pocket member, a clip member attached to a rear portion of the support case for engaging one of several pockets within a handbag, and a shaft having a loop pivotally attached to an upper end for securing at least one key thereto. The shaft is slidably positionable within the pocket member of the support case thereby maintaining the key in a convenient location within the handbag. A capturing member such as a detent ball structure may be utilized to maintain the shaft within the pocket member during extreme movements of the handbag. A sleeve member may also be positioned within the pocket member for increasing the strength of the pocket member during extended usage.

19 Claims, 4 Drawing Sheets

ARTICLE HOLDING ASSEMBLY FOR A PURSE

BACKGROUND OF THE INVENTION

1. Field of the Invention

The present invention relates generally to key holding devices and more specifically it relates to an article holding assembly for a purse for conveniently storing a plurality of keys within a purse or other bag with the keys positioned in an easily accessed area within the purse.

Individuals who utilize bags such as purses to store and carry their personal possessions often times temporarily position their keys within the bag. Due to movements of the bag, the keys generally fall to the bottom portion of the bag underneath any objects in the bag which make it extremely difficult for the individual to locate the keys when desired. Hence, there is a need for a key storage structure that conveniently retains a user's keys within a bag such as a purse.

2. Description of the Prior Art

Key holding devices have been in use for years. Typically, a key holder comprises a plurality of hooks attached to a board member that is attached to a wall within a house. Unfortunately, these devices are not usable within the close confines of a bag such as a purse.

Examples of attempted key holding devices include U.S. Pat. No. 4,004,325 to Hubachek; U.S. Pat. No. 3,025,580 to Castle; U.S. Pat. No. 4,940,250 to Corrado; U.S. Pat. No. 2,117,989 to Ryan; U.S. Pat. No. 3,707,742 to Justice et al.; U.S. Pat. No. 3,978,902 to Adkinson; U.S. Pat. No. 3,682,216 to Nelson; U.S. Pat. No. 349,398 to Ezzo; U.S. Pat. No. 277,710 to Engle et al.; U.S. Pat. No. 5,842,365 to Bordonaro; U.S. Pat. No. 5,682,981 to Sudborough; U.S. Pat. No. 5,794,768 to Skeffington et al. which are all illustrative of such prior art.

Hubachek (U.S. Pat. No. 4,004,325) discloses a key ring and/or chain holder. Hubachek teaches a bracket arranged for being fixed to a support member and releasably receiving an attaching member having at least one key fastened to it for connecting the key to the bracket.

Castle (U.S. Pat. No. 3,025,580) discloses a purse lining supported key holder. Castle teaches a plate member having a plurality of claws extending from the plate member for piercing the lining of the purse, and a loop member for receiving a narrow portion of a conventional key.

Corrado (U.S. Pat. No. 4,940,250) discloses a magnetic key holder. Corrado teaches a rigid magnetic body removably attachable to the purse and a metal strip having a key ring attached thereto.

Ryan (U.S. Pat. No. 2,117,989) discloses a handbag key retainer. Ryan teaches plate member secured within the interior lining of the purse having a plurality of hooks for capturing one or more keys.

While these devices may be suitable for the particular purpose to which they address, they are not as suitable for conveniently storing a plurality of keys within a purse or other bag with the keys positioned in an easily accessed area within the purse. Conventional key holding devices are not as suitable for retaining keys within an interior of a bag such as a purse.

In these respects, the article holding assembly for a purse according to the present invention substantially departs from the conventional concepts and designs of the prior art, and in so doing provides an apparatus primarily developed for the purpose of conveniently storing a plurality of keys within a purse or other bag with the keys positioned in an easily accessed area within the purse.

SUMMARY OF THE INVENTION

In view of the foregoing disadvantages inherent in the known types of key holders now present in the prior art, the present invention provides a new article holding assembly for a purse construction wherein the same can be utilized for conveniently storing a plurality of keys within a purse or other bag with the keys positioned in an easily accessed area within the purse.

The general purpose of the present invention, which will be described subsequently in greater detail, is to provide a new article holding assembly for a purse that has many of the advantages of the key holders mentioned heretofore and many novel features that result in a new article holding assembly for a purse which is not anticipated, rendered obvious, suggested, or even implied by any of the prior art key holders, either alone or in any combination thereof.

To attain this, the present invention generally comprises a support case having a pocket member, a clip member attached to a rear portion of the support case for engaging one of several pockets within a handbag, and a shaft having a loop pivotally attached to an upper end for securing at least one key thereto. The shaft is slidably positionable within the pocket member of the support case thereby maintaining the key in a convenient location within the handbag. A capturing member such as a detent ball structure may be utilized to maintain the shaft within the pocket member during extreme movements of the handbag. A sleeve member may also be positioned within the pocket member for increasing the strength of the pocket member during extended usage.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an article holding assembly for a purse that will overcome the shortcomings of the prior art devices.

Another object is to provide an article holding assembly for a purse that conveniently stores a user's keys within a bag.

An additional object is to provide an article holding assembly for a purse that reduces the amount of time required to locate a user's keys within a bag.

A further object is to provide an article holding assembly for a purse that does not require permanent modifications to a bag.

Another object is to provide an article holding assembly for a purse that can be utilized in various bags.

An additional object is to provide an article holding assembly for a purse that is attachable to a pocket within the interior lining of a bag.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
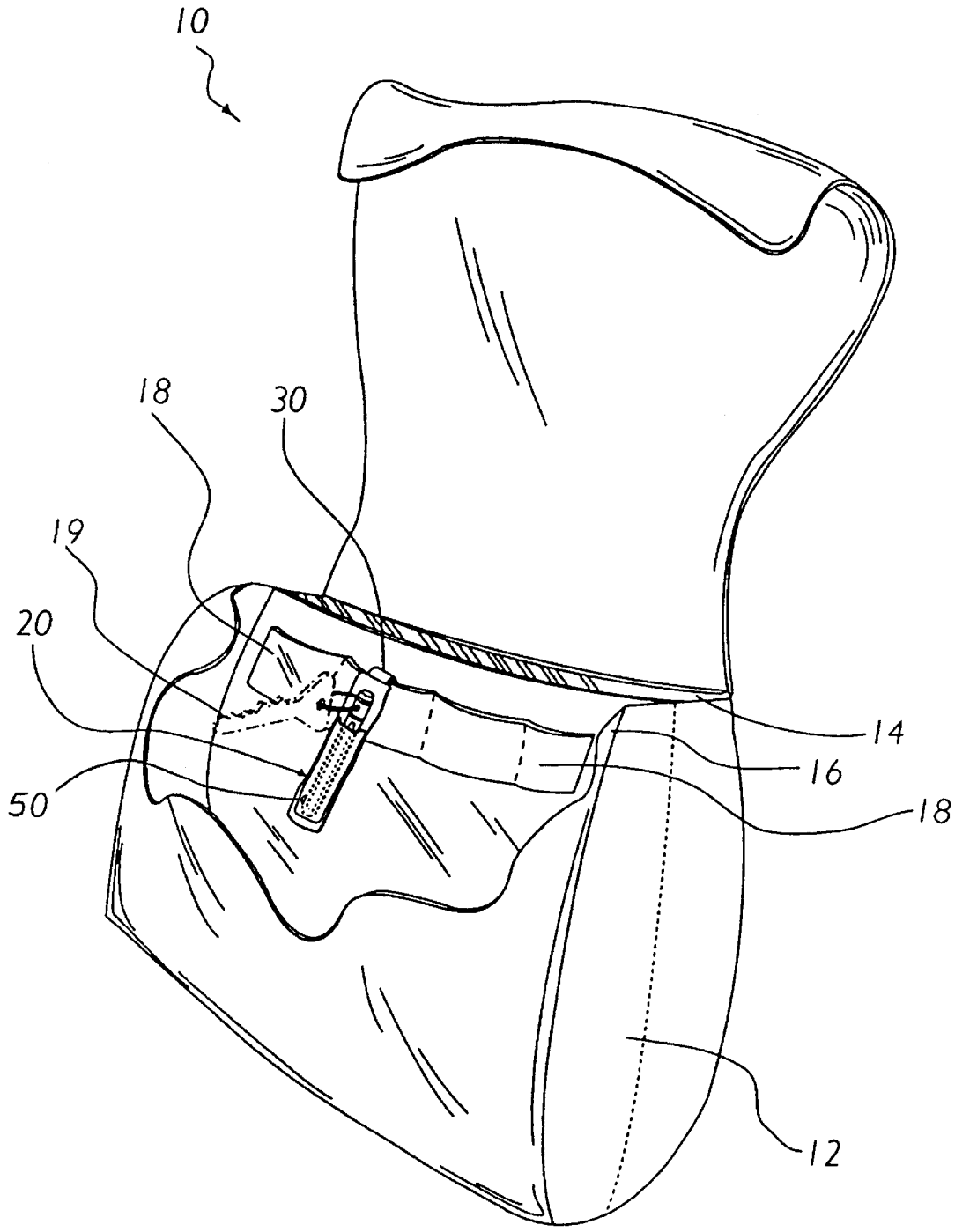
FIG. 1 is an upper perspective view of the present invention positioned within the interior of a purse.

Turning now descriptively to the drawings, in which similar reference characters denote similar elements throughout the several view, FIGS. 1 through 4 illustrate an article holding assembly for a purse 10, which comprises a support case 20 having a pocket member 24, a clip member 30 attached to a rear portion of the support case 20 for engaging one of several pockets 18 within a handbag 12, and a shaft 40 having a loop 46 pivotally attached to an upper end 42 for securing at least one key thereto. The shaft 40 is slidably positionable within the pocket member 24 of the support case 20 thereby maintaining the key 19 in a convenient location within the handbag 12. A capturing member such as a detent ball structure may be utilized to maintain the shaft 40 within the pocket member 24 during extreme movements of the handbag 12. A sleeve member may also be positioned within the pocket member 24 for increasing the strength of the pocket member 24 during extended usage.

As shown in FIG. 1 of the drawings, a conventional handbag 12 generally includes at least one side wall, a bag opening 14, at least one partition 16, and generally a plurality of pockets 18 within for receiving smaller articles such as wallets. As can be appreciated, the smaller heavier objects such as keys 19 generally fall to the bottom of the handbag 12 making it extremely difficult to retrieve the keys 19 from within the handbag 12 such as a purse.

Figure 2:
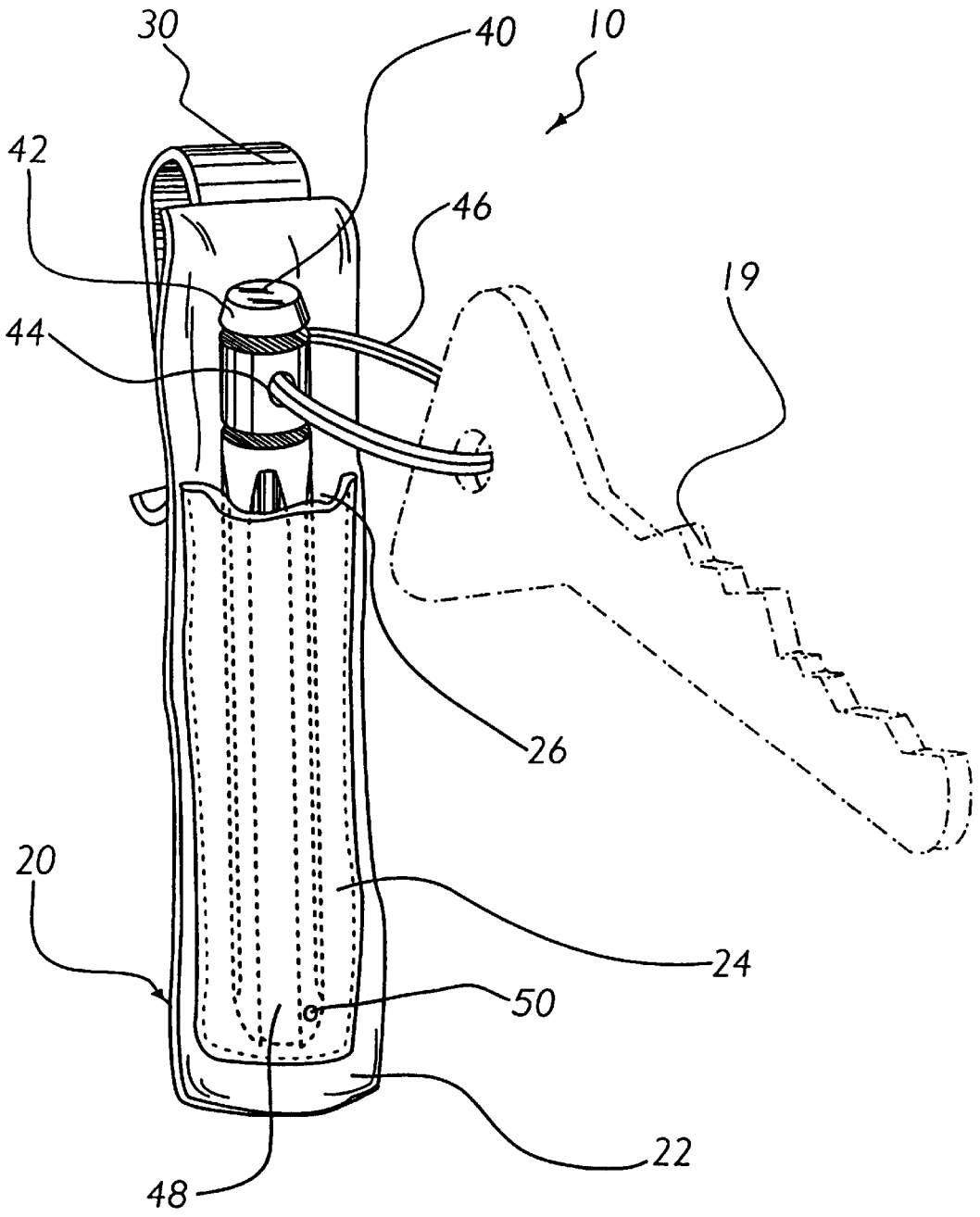
FIG. 2 is an upper perspective view of the present invention.
Figure 3:
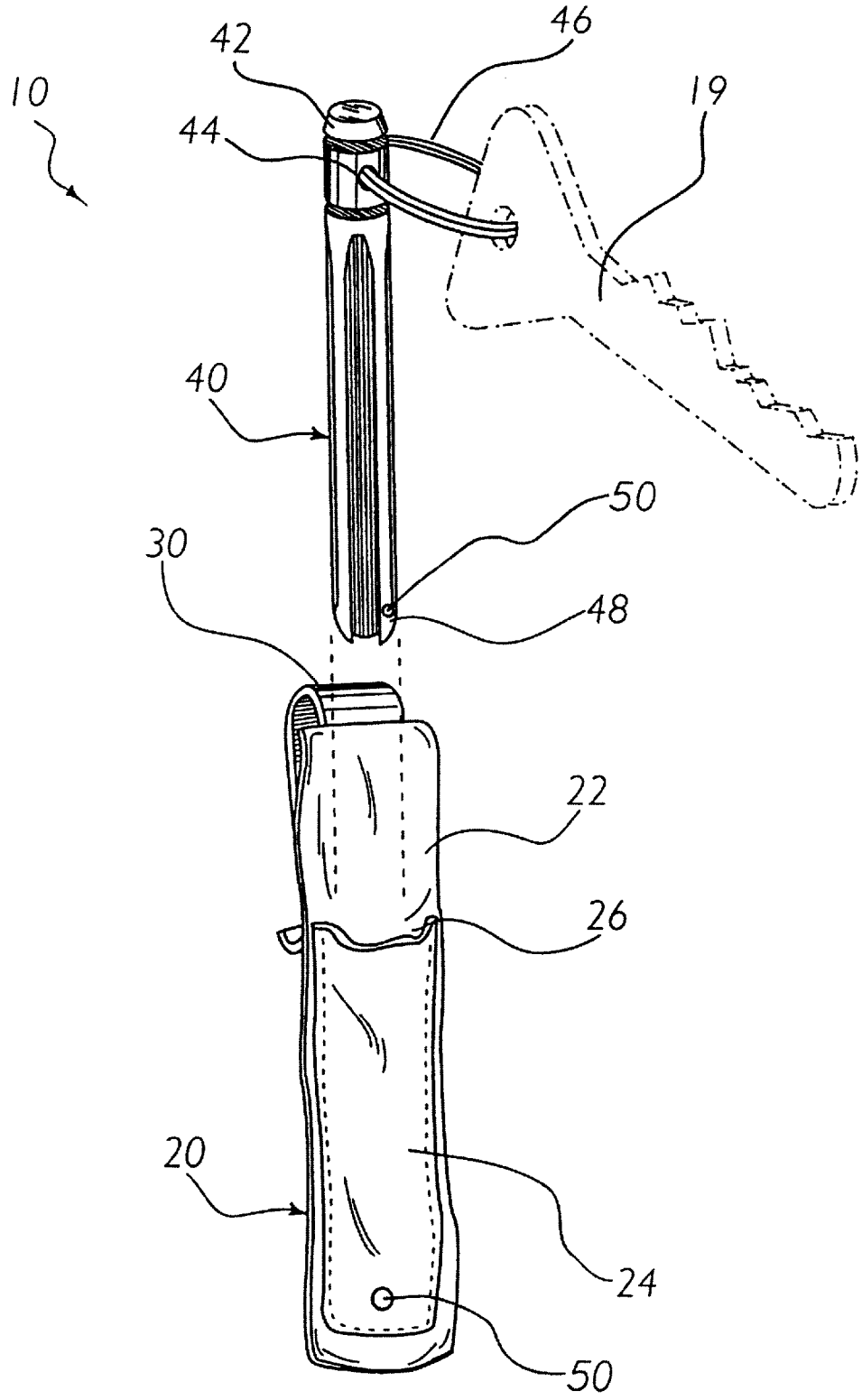
FIG. 3 is an exploded upper perspective view of the present invention.
Figure 4:
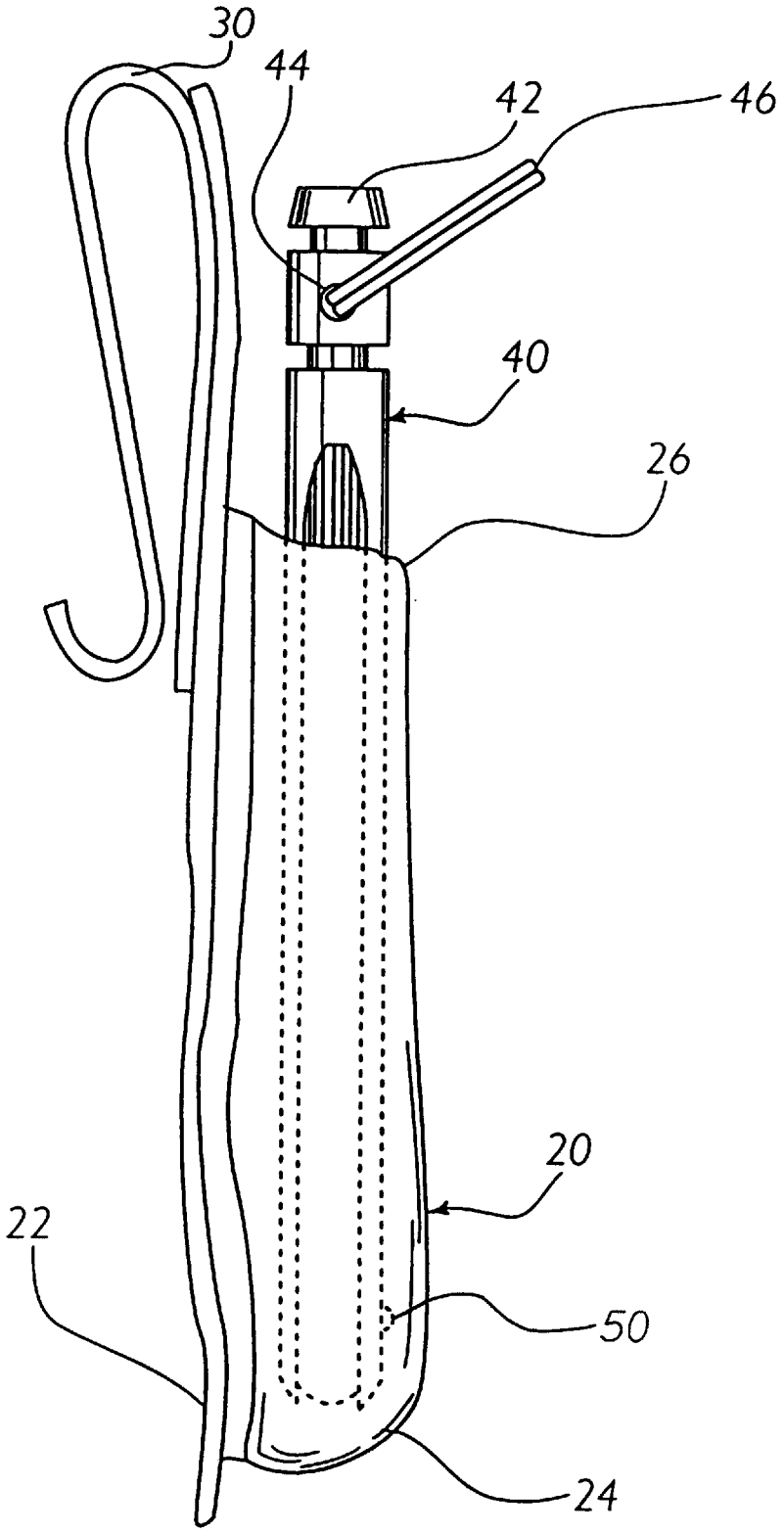
FIG. 4 is a side view of the present invention.

As best shown in FIGS. 2 through 4 of the drawings, the support case 20 includes a flat base 22. The base 22 may be constructed of any well-known material, however the base 22 is preferably constructed so as to have a rigid structure.

As shown in FIGS. 1 through 4 of the drawings, a pocket member 24 is secured to the front portion of the support case 20 by a conventional securing means. The pocket member 24 is preferably an elongated structure having the sides and bottom portions attached to the base 22. The pocket member 24 has a semi-circular cross sectional area large enough to removably receive the shaft 40.

As best shown in FIG. 3, the pocket member 24 further includes an upper opening 26 for receiving the shaft 40. The base 22 extends above the upper opening 26 of the pocket member 24 as best shown in FIG. 4 of the drawings. A sleeve member may be utilized that is inserted within the interior of the pocket member 24 for making the pocket member 24 more rigid.

As best shown in FIG. 4 of the drawings, a clip member 30 is secured to the rear surface of the base 22 opposite of the pocket member 24. The clip member 30 is preferably attached along the upper portion of the base 22 for providing increased stability while positioned within a handbag 12. The clip member 30 has a broader upper portion with a narrowing lower portion for tightening against a pocket 18 within the handbag 12, thereby supporting the support case 20 in a substantially vertically orientated position.

As best shown in FIG. 3 of the drawings, a shaft 40 is provided having an upper end 42 and a lower end 48. The upper end 42 of the shaft 40 includes an aperture 44 for pivotally receiving a loop 46. The loop 46 is constructed to receive one or more keys 19 for the user. The outer perimeter of the shaft 40 is smaller than the interior of the pocket member 24 thereby allowing the shaft 40 to be removably positioned within the pocket member 24 when the keys 19 are attached thereto. A locking means such as a ball and detent system 50 may be utilized to maintain the shaft 40 captured within the pocket member 24.

In use, the user positions the support case 20 in a desired and convenient location within the interior of the handbag 12. The user attaches the clip member 30 about a pocket 18 or other structure within the handbag 12 thereby supporting the support case 20 in a substantially vertical position. The user then attaches one or more keys 19 to the loop 46 and thereafter utilizes their keys 19 as they generally would for driving a vehicle or unlocking a building structure. When the user no longer requires the keys 19, the user then positions the lower end 48 of the shaft 40 within the upper opening 26 of the pocket member 24 and continues to push the shaft 40 downwardly into the pocket member 24 until the shaft 40 is securely positioned within. The user then closes the cover of the purse and continues as usual. When the user requires usage of the keys 19 again, the user then locates the shaft 40 within the interior of the handbag 12 and slidably removes the shaft 40 from within the pocket member 24 thereby allowing the user to utilize the keys 19 attached thereto. The user may also remove the support case 20 and position the support case 20 in another handbag 12 if desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An article holding assembly for a purse, comprising:

a support case comprised of an elongate tubular structure having a lumen;

a member slidably positionable within said support case, wherein said member is an elongate structure positionable within said lumen and is capable of retaining at least one key; and a securing means secured to a rear surface of said support case, wherein said securing means allows said support case to be secured within an interior portion of a handbag.

2. The article holding assembly for a purse of claim 1, wherein said securing means comprises a clip member.

3. The article holding assembly for a purse of claim 2, wherein said support case comprises:

a base, wherein said clip member is secured to a rear surface of said base; and a pocket member secured to a front surface of said base.

4. The article holding assembly for a purse of claim 3, wherein a pair of sides and a bottom of said pocket member are secured to said base.

5. The article holding assembly for a purse of claim 1, including a loop pivotally attached to said member, wherein said loop is capable of receiving said at least one key.

6. The article holding assembly for a purse of claim 2, wherein said clip member is secured to an upper portion of said base.

7. The article holding assembly for a purse of claim 3, wherein said base is constructed of a rigid structure.

8. The article holding assembly for a purse of claim 1, including a capturing means within said pocket member for capturing said member.

9. The article holding assembly for a purse of claim 8, wherein said capturing means is comprised of a ball and detent system.

10. An article holding assembly for a purse, comprising:

a support case having a rigid base, and a pocket member having a pair of sides and a bottom secured to a front face of said base;

a member slidably positionable within said support case, wherein said member includes a loop capable of retaining at least one key;

a clip member secured to an upper portion of a rear surface of said base, wherein said clip member allows said support case to be secured within an interior portion of a handbag; and a capturing means within said pocket member for capturing said member.

11. The article holding assembly for a purse of claim 10, wherein said capturing means is comprised of a ball and detent system.

12. An article holding assembly for a purse, comprising:

a support case comprised of an elongate tubular structure having a lumen;

a member slidably positionable within said support case, wherein said member is an elongate structure positionable within said lumen and is capable of retaining at least one key;

a securing means secured to a rear surface of said support case, wherein said securing means allows said support case to be secured within an interior portion of a handbag; and a capturing means within said pocket member for capturing said member.

13. The article holding assembly for a purse of claim 12, wherein said securing means comprises a clip member.

14. The article holding assembly for a purse of claim 13, wherein said support case comprises:

a base, wherein said clip member is secured to a rear surface of said base; and a pocket member secured to a front surface of said base.

15. The article holding assembly for a purse of claim 14, wherein said base is constructed of a rigid structure.

16. The article holding assembly for a purse of claim 15, wherein a pair of sides and a bottom of said pocket member are secured to said base.

17. The article holding assembly for a purse of claim 14, wherein said clip member is secured to an upper portion of said base.

18. The article holding assembly for a purse of claim 12, including a loop pivotally attached to said member, wherein said loop is capable of receiving said at least one key.

19. The article holding assembly for a purse of claim 12, wherein said capturing means is comprised of a ball and detent system.

* * * * *